US005492379A

United States Patent [19]

Staser et al.

[11] Patent Number: 5,492,379

[45] Date of Patent: Feb. 20, 1996

[54] GUIDED LINKING MECHANISM

[75] Inventors: Brian H. Staser, Troy; Danny W. Figlioli, Macomb Township, both of Mich.

[73] Assignee: General Motors Corporation, Detroit, Mich.

[21] Appl. No.: 265,905

[22] Filed: Jun. 27, 1994

[51] Int. Cl.[6] ..... E05B 3/00

[52] U.S. Cl. ..... 292/336.3; 292/DIG. 25; 403/184; 403/301; 74/503; 49/503

[58] Field of Search ..... 292/336.3, 202, 292/195, 196, 336.5, DIG. 25; 403/184, 182, 301; 49/503; 74/503

[56] References Cited

U.S. PATENT DOCUMENTS

| | | | |
|---|---|---|---|
| 3,455,179 | 7/1969 | Nielsen | 74/503 |
| 5,251,403 | 10/1993 | Compeau et al. | 49/502 |
| 5,253,906 | 10/1993 | Rogers, Jr. et al. | 292/216 |

FOREIGN PATENT DOCUMENTS

| | | | |
|---|---|---|---|
| 809101 | 3/1969 | Canada | 292/336.3 |
| 1935280 | 1/1971 | Germany | 292/336.3 |
| 822405 | 10/1959 | United Kingdom | 292/DIG. 25 |

*Primary Examiner*—Rodney M. Lindsey
*Attorney, Agent, or Firm*—Jeffrey A. Sedlar

[57] ABSTRACT

A mechanical linking system includes a slidably supported guided link interposed between two operable rods. The operable rods are connected to an operator device and an operated device. A mechanical transfer is effected through the rods and guided link between the operator and the operated device.

3 Claims, 2 Drawing Sheets

GUIDED LINKING MECHANISM

BACKGROUND OF THE INVENTION

This invention relates to a guided mechanical link.

It is conventional to provide a mechanical link between two components of a machine wherein movement of one of the components effects a responsive movement in the other component by means of the inter-attached link. In situations where the mechanical link is relatively long, handling and routing difficulties can be encountered in assembling the link between the two machine components. Additionally, the link may exhibit a propensity to bend, bow or generate noise. Accordingly, a solution resulting in assembly simplification and wherein the linking system is sturdier and less apt to bend, bow or generate noise is required.

SUMMARY OF THE INVENTION

The present invention is directed to a linking system that serves to guide and operatively connect a mechanical operator device of a machine and a mechanical operated device of the machine. The linking system includes a guided link disposed in a sliding relationship between a plurality of guides to provide a stable support for two independent links attached thereto. The two independent links are attached to the guided link through means of a simplified, quick snap together assembly system.

The guided link permits the length of the individual independent links to be reduced, thereby making them more readily assembled within the machine. The guides which support the guided link, provide a means to inhibit bowing, bending and noise generation of the linking system.

An advantage of the present invention is that the mechanical operator device of the machine and the mechanical operated device of the machine are more readily installed and removed from the machine assembly because the guided link element in the mechanical linking system can be placed in a readily accessible location, thereby aiding in the flexibility of manufacturing and concomitantly, simplifying disassembly.

A further advantage of the present invention resides in the adaptability of the guided link to an adjustable rod attachment mechanism. Adjustability in attaching a rod to the guided link reduces the amount of over-travel that is otherwise required of the machine's mechanical operator device. Operator over-travel is conventionally required to ensure that the mechanical operated device functions properly, when operated, regardless of machine build variation.

DETAILED DESCRIPTION OF THE PRESENTLY PREFERRED EMBODIMENT

The guided linking mechanism according to the present invention is described within the context of a vehicle door for use in linking an interior door handle to the door latch. It is apparent that the interior door handle which is a mechanical operator device of the vehicle door and the vehicle door latch which is a mechanical operated device of the vehicle door represent machine elements which are mechanically linked together to operate in concert. Therefore, this embodiment is only representative of those in which the guided linking system of the present invention may be utilized to operatively connect machine elements. Another example of a mechanical system to which the invention may be applied is a vehicle door's lock knob and linked latch lock mechanism.

Figure 1:
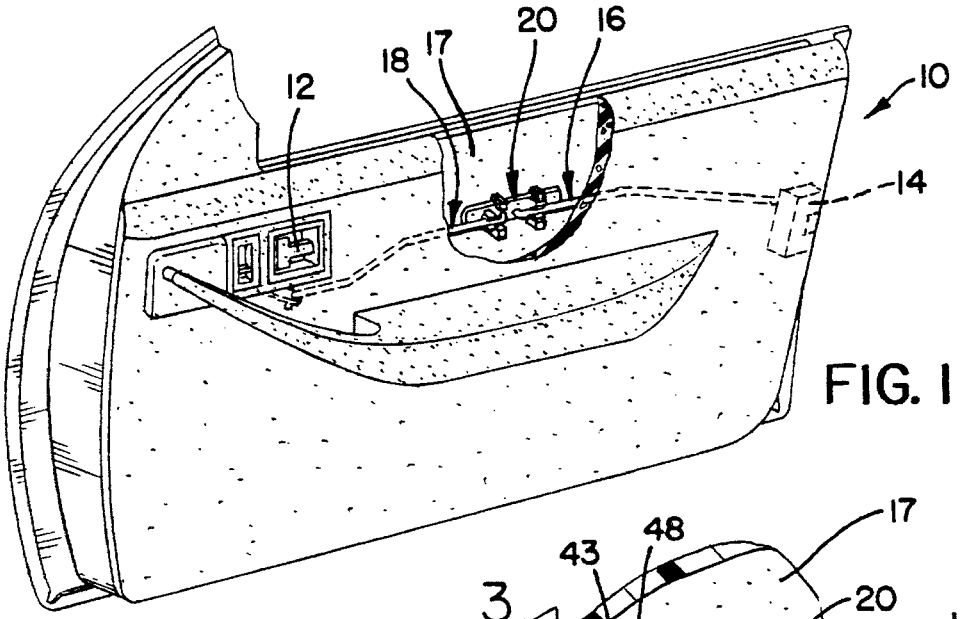
FIG. 1 is an illustration of a vehicle door including the present invention.

Referring to FIG. 1, a vehicle door is partially illustrated and designated generally as 10. Carried by door 10 is panel 17, which is preferably molded from plastic. Mounted in the vehicle door are interior handle 12 and latch 14. Interior handle 12 is mechanically linked to latch 14 through the inter-positioned handle rod 18, guided link 20 and latch rod 16.

Operation of interior handle 12 effects the resultant movement of handle rod 18, guided link 20 and latch rod 16. Latch rod 16 thereby operates latch 14 in response to movement of interior handle 12. Guided link 20 is supported by guides 41–44 which project from door mounting panel 17 and are preferably integrally molded therewith.

Figure 2:
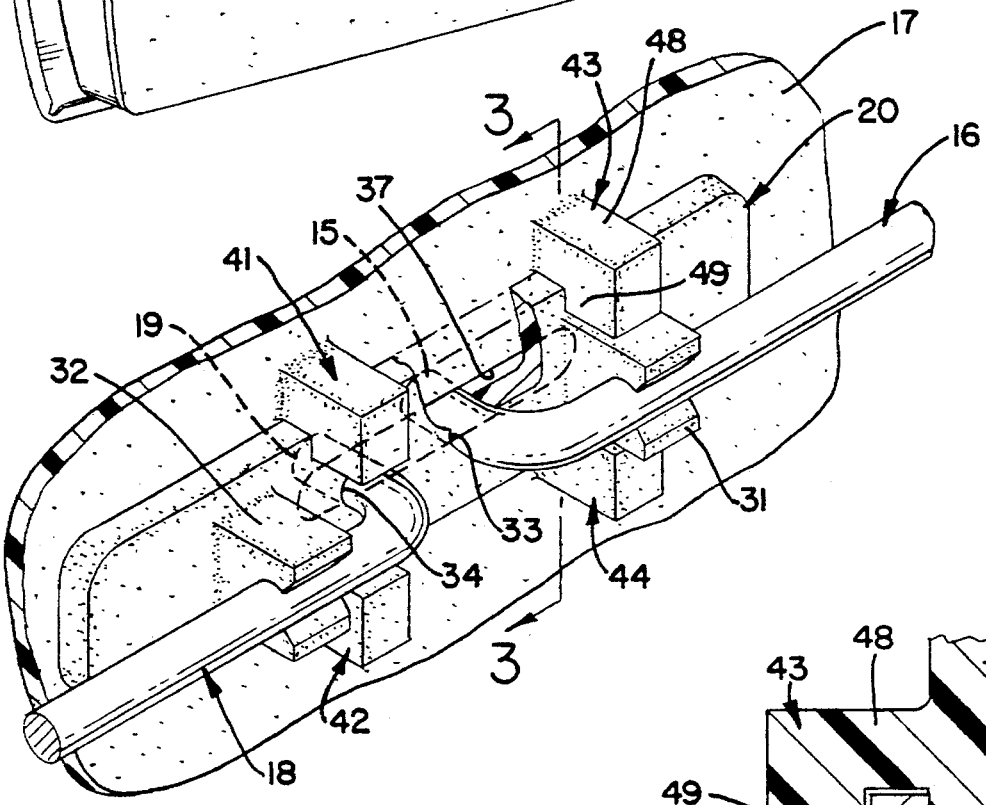
FIG. 2 is an illustration of a guide link according to the present invention.
Figure 3:
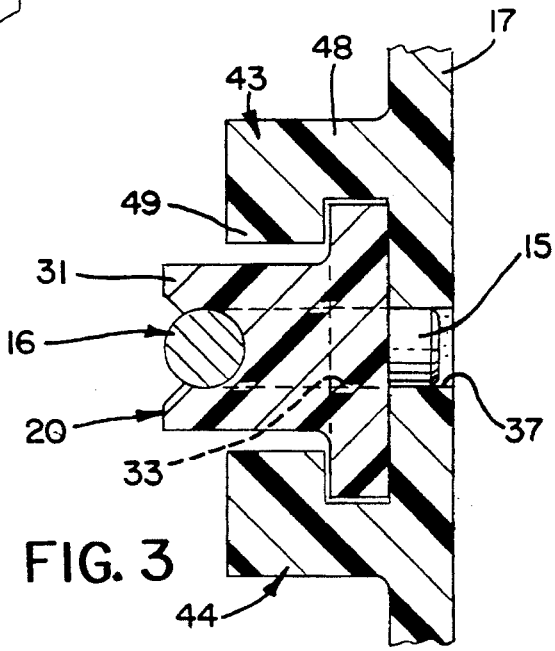
FIG. 3 is a cross-sectional view taken generally through plane indicated by line 3—3 in FIG. 2.

FIGS. 2 and 3 illustrate guided link 20 in greater detail. Guided link 20 is slidably supported on door mounting panel 17 by the four guide members 41–44. Each of guide members 41–44 includes a guide block, represented by guide block 48, which extends from panel 17. The four guide blocks serve to restrict movement of guided link 20 in one axial direction.

Each of the guide members 41–44 includes a cantilevered member represented by cantilevered member 49, extending from their respective guide block. Guide members 41 and 42 comprise an opposed pair of guides with their respective cantilevered members directed toward the paired opposed guide member. Likewise, guide members 43 and 44 comprise an opposed pair of guides. The four cantilevered members, in combination with panel 17, restrict movement of guided link 20 in a second axial direction. Guided link 20 is free to slide in the third axial direction as supported by guide members 41–44.

Guided link 20 is preferably made of plastic. Therefore, relative sliding motion occurs between two plastic surfaces, those of guided link 20 and guides 41–44, which tends to be quieter and less disposed to squeaking than would be the case with metal on plastic relative sliding motion.

Latch rod 16 is connected to guided link 20 by means of a snap fitting attachment in rod clip 31 and the end 15 of rod 16 is disposed in the round rod end opening 33 in guided link 20. Handle rod 18 is connected to guided link 20 by means of a snap fitting attachment in rod clip 32 and the end 19 of handle rod 18 is disposed in the round rod end opening 34 in guided link 20. FIG. 3 shows the end 15 of latch rod 16 disposed in rod end opening 33. So as not to interfere with sliding motion, panel 17 includes slot 37 so that the ends of rods 16 and 18 may extend through the base 21 of guided link 20.

Figure 7:
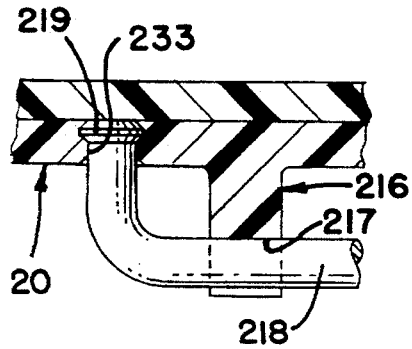
FIG. 7 is a cross-sectional view of an alternative embodiment of the invention.

An alternative means for connecting a rod to guided link 20 is illustrated in FIG. 7. Rod 218 terminates in enlarged head 219. Enlarged head 219 snaps into rod end aperture 233 in guided link 20. Rod 218 is positioned through aperture 217 in rod support 216.

The connected structure permits quick assembly and disassembly of handle rod 18 and latch rod 16 from guided link 20. The placement of guided link 20 in the linking system between interior handle 12 and latch 14 significantly reduces the length of the individual rods in the linking system. The reduced length of individual elements adds flexibility and ease to the assembly and disassembly process. The interposed guided link 20 provides support near the mid-point of the linking system thereby reducing bowing and bending of the linking system and reducing the opportunity for noise generation to occur.

The guided link 20 holds handle rod 18 and latch rod 16 in alignment as if they were one continuous rod. The sliding motion of guided link 20 is relative to door mounting panel 17 and passes through the guides 41–44 to slidably support the linking system. This linking system can be used to relocate the assembly attachment points of handle rod 18 and latch rod 16. Guided link 20 places the rod attachment points in an easily assessable area in the door. Therefore, handle 12 and handle rod 18 are installed and removed from door 10 as an assembly, with simple, readily accessible attachment to the linking system made at guided link 20. Similarly, latch 14 and latch rod 16 are installed and removed as an assembly.

Figure 4:
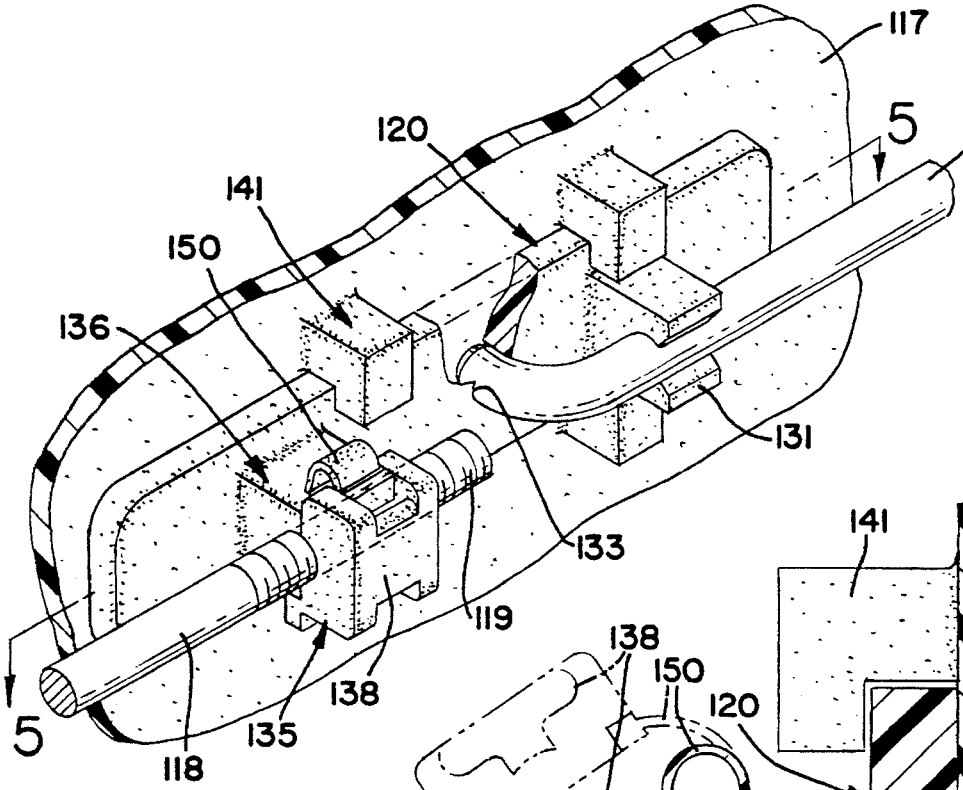
FIG. 4 is an alternative embodiment of a guide link of the present invention.
Figure 6:
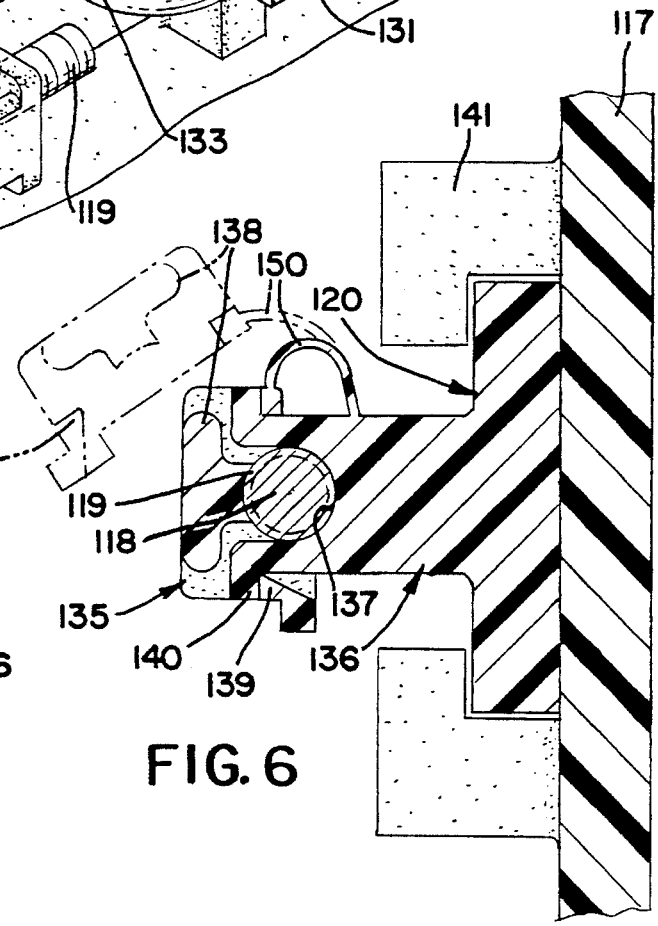
FIG. 6 is a cross-sectional view taken generally through the plane indicated by the line 6—6 in FIG. 5.
Figure 5:
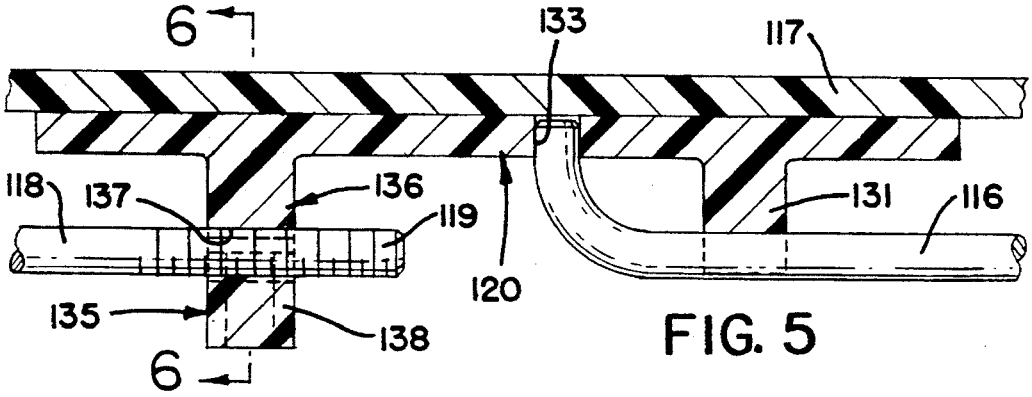
FIG. 5 is a cross-sectional view taken generally through the plane indicated by the line 5—5 in FIG. 4.

FIGS. 4, 5 and 6 illustrate an alternative embodiment of the guided link member according to the present invention. This embodiment permits adjustment in the linking system and is made possible through the means of attaching at least one of the linking rods to the guided link 120 with an adjustable clip 135.

Latch rod 116 is attached to guided link 120 by link 131 and the end of latch rod 116 is disposed in rod end opening 133. Handle rod 118 is adjustably attached to guided link 120 by means of adjustable clip 135, including rod support 136 and hinged clip 138. Handle rod 118 includes threaded section 119 which is adjustably positionable in cavity 137 of rod support 136. When the threaded section 119 of handle rod 118 is selectively positioned in a properly adjusted location in cavity 137, hinged rod clip 138 is snap fittingly attached to rod support 136 thereby locking handle rod 118 in position and releasably attaching it to guided link 120.

Hinged rod clip 138 is preferably integrally molded as part of rod support 136 which extends from guided link 120. Flexible arm 150 permanently connects hinged rod clip 138 to rod support 136 in a hinged relationship. Rod clip 138 is readily attached or detached from rod support 136 through means of tab 139 which clips over projection 140.

The combination of threaded section 119 of handle rod 118, rod support 136 and rod clip 138 permit a range of infinite adjustments to be made in the linking system between interior handle 12 and latch 14 of the door system. FIG. 5 shows the range of adjustment that is possible along the threaded section 119 of handle rod 118 as disposed between rod support 136 and rod clip 138. The guided link 120 holds handle rod 118 and latch rod 116 in alignment as if they were one continuous rod. Guided link 120 is slidably supported by four guides represented by guide 141 integrally projecting from door mounting panel 117.

The guided link 120 provides support for the linking system between interior handle 12 and latch 14. The combination of threaded section 119 with support 136 and rod clip 138 provides the advantage of presenting a means to quickly and easily adjust the length of the linkage assembly. Rod clip 138, along with guided link 120, may be selectively positioned in a readily accessible location to assist in adjustment and in assembly and disassembly of the linkage system.

What is claimed is:

1. A mechanical linking system for operably connecting an operator device with an operated device comprising:

a guide link including a substantially planar base slidably supported by a plurality of guides with a pair of rod clips extending from a common side of the base and having a rod end aperture positioned in the base adjacent to each rod clip;

a first rod having a first end disposed in one of the rod end apertures and snap fittingly engaging the adjacent rod clip and having a second end connected to the operator device; and a second rod having a first end disposed in the other rod end aperture and snap fittingly engaging the adjacent rod clip and having a second end connected to the operated device.

2. A mechanical linking system for operably connecting an operator device with an operated device comprising:

a guide link including a substantially planar base slidably supported by a plurality of guides with a first rod clip extending from the base exhibiting an opening adapted to engageably receive a longitudinal section of rod therein and having a rod end aperture in the base positioned adjacent to the first rod clip and a second rod clip exhibiting an opening to engageably receive a longitudinal section of rod therein and including a hinged cap which snap fittingly engages the second rod clip over the opening to close the opening and clamp the section of rod therein;

a first rod having a threaded section near an end clamped in the second rod clip opening by the hinged cap; and a second rod having an end disposed in the rod end aperture and snap fittingly engaging the adjacent first rod clip.

3. A mechanical linking system for a vehicle door having a latch and a handle to operate the latch comprising:

a panel mounted in the door having two pairs of opposed guide members extending therefrom, each guide member including a guide block extending from the panel and a cantilevered beam extending from the guide block, the cantilevered beams of each guide member directed toward the paired opposed guide member;

a guide link including a substantially planar elongated base slidably supported by the guide members, having a first rod clip extending from the base and having a rod end aperture positioned in the base near the first rod clip;

a first rod having a first end connected to the latch for operation thereof and a second end disposed in the rod end aperture, the second end forming the terminating end of a bent section of the first rod and the first rod, adjacent to the bent section being snap fittingly engaged by the first rod clip;

a second rod clip extending from the base having a hinged cap molded integrally therewith and forming an openable closure for the second rod clip; and a second rod having a first end connected to the handle for operation thereby and having a second threaded end adjustably captured in the openable closure.

* * * * *